US005259014A

United States Patent [19]

Brettschneider

[11] Patent Number: 5,259,014

[45] Date of Patent: Nov. 2, 1993

[54] X-RAY TUBE

[75] Inventor: Horst Brettschneider, Ellerau, Fed. Rep. of Germany

[73] Assignee: U.S. Philips Corp., New York, N.Y.

[21] Appl. No.: 806,025

[22] Filed: Dec. 12, 1991

[30] Foreign Application Priority Data

Jan. 8, 1991 [DE] Fed. Rep. of Germany ..... 4100297

[51] Int. Cl.[5] ..... H01J 35/06

[52] U.S. Cl. ..... 378/138; 378/136; 378/137

[58] Field of Search ..... 378/136, 137, 138, 114, 378/115, 134

[56] References Cited

U.S. PATENT DOCUMENTS 4,002,917 1/1977 Mayo ..... 250/445

5,142,652 8/1992 Reichenberger et al. ..... 378/136

*Primary Examiner*—David P. Porta

*Attorney, Agent, or Firm*—Jack D. Slobod

[57] ABSTRACT

An X-ray tube has a focal spot which can be varied in respect of position or size. A cathode has dimensions adapted to the variation of the focal spot, and between the cathode and the anode of the X-ray tube there is a grid arrangement which comprises a number of grid elements in one plane, which elements are electrically insulated from one another, and whose potential is independently controlled.

4 Claims, 1 Drawing Sheet

X-RAY TUBE

FIELD OF THE INVENTION

The invention relates to an X-ray tube for generating a variable focal spot.

BACKGROUND OF THE INVENTION

For computer tomography X-ray tubes are known in which the position of the focal spot on the anode changes periodically. The changing of the position of the focal spot is realized therein, for example by a magnetic deflection unit. Such an X-ray tube requires a comparatively long deflection path, i.e. a comparatively long distance between the anode and the cathode. The shorter this distance (and the higher the maximum tube voltage), the higher the deflection power will be. For the short distances occurring between the anode and the cathode in a rotary anode X-ray tube, such deflection is hardly possible.

SUMMARY OF THE INVENTION

It is an object of the present invention to provide an X-ray tube in which the size and/or position of the focal spot can be changed in the case of a short distance between the anode and the cathode.

This object is achieved in accordance with the invention in that there is provided a cathode whose dimensions are adapted to focal spot dimension variation, and in that between the cathode and the anode of the X-ray tube there is a grid arrangement which comprises a number of grid elements arranged in one plane, which are electrically insulated from one another and whose potential can be controlled independently of one another.

Thus, in accordance with the invention in a plane between the cathode and the anode there is provided a grid arrangement comprising a plurality of grid elements which are electrically insulated from one another and whose potential can be controlled independently of one another. This grid arrangement substantially shields the cathode from the anode, so that when a blocking voltage is applied to the grid elements, the electrons from the cathode cannot reach the anode. Electrons can pass the area around the relevant grid element only if at least one of the grid element is connected to a suitable potential, the electrons then being incident on the part of the anode which faces the relevant grid element, thus producing a focal spot.

The size of the focal spot can be varied by connecting a smaller or larger number of grid elements, covering a coherent area of the cathode, simultaneously to an appropriate potential. In a preferred embodiment of the invention, the position of the focal spot can be changed in that for the displacement of the focal spot in a direction the grid arrangement comprises grid elements which are adjacently arranged in the displacement direction and which can be successively connected to a potential such that the electrons emitted by the cathode can pass the grid each time at the area of the grid element receiving said potential.

A single grid element or several neighboring grid elements can then be connected to the "transmission" potential. When only a single grid element is connected, the grid element carrying the "transmission" potential is connected to a "blocking" potential immediately before the switching-over to the next neighboring grid element, after which the next grid element is connected to the "transmission" potential. Thus, at any instant no more than one grid element is connected to the "transmission" potential. When several grid elements are connected to the transmission potential, the control procedure is performed accordingly. The deflection of the electron beam is then step-wise and substantially powerless.

BRIEF DESCRIPTION OF THE DRAWING

The invention will be described in detail hereinafter with reference to the drawing. Therein.

DESCRIPTION OF THE PREFERRED EMBODIMENT

Figure 1:
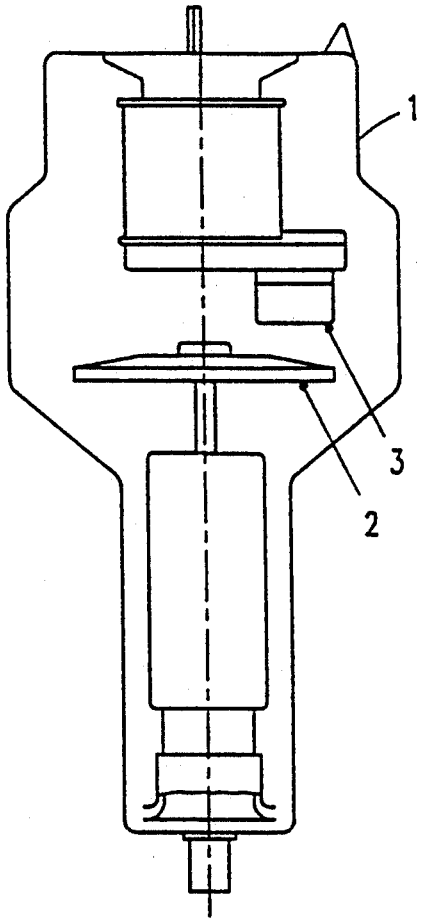
FIG. 1 shows an X-ray tube in which the invention is implemented

FIG. 1 shows a rotary anode X-ray tube which comprises, accommodated in a glass envelope 1, a rotary anode arrangement 2 and a grid cathode arrangement 3. In the operating condition, a high voltage of up to 150 kV is present between the arrangements 2 and 3, the potential being symmetrically distributed relative to ground (+75 kV, −75 kV). The grid-cathode arrangement 3 emits an electron beam which is incident on the rotary anode arrangement 2 at the focal spot where it generates X-rays. The electron beam is periodically moved in the tangential direction of the rotary anode, i.e. approximately perpendicularly to the plane of drawing of FIG. 1, so that the position of the focal spot on the rotary anode is periodically displaced in the tangential direction.

Figure 2:
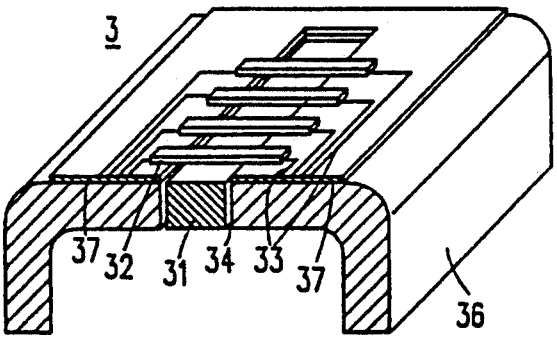
FIG. 2 is a perspective sectional view of a preferred cathode grid arrangement according to an embodiment of the invention.

FIG. 2 is a perspective view, taken parallel to the plane of drawing of FIG. 1, of the grid-cathode arrangement 3. The arrangement comprises a cathode head 36 having an approximately U-shaped cross-section. In the center of the cathode head there is a slit 34 in which is an elongate electron emitter 31. The electron emitter 31 is constructed so that the number of electrons emitted per unit of surface area in the operating condition is constant over its entire length. The dimensions, and possibly its shape are adapted to the path to be followed by the focal spot on the anode in the operating condition. A dispenser cathode can be used as the electron emitter or an indirectly heated cathode.

At the side of the cathode head 36 which faces the anode, a layer 37 of an insulating material is provided around the slit. On the layer there is a grid arrangement which consists of a number of uniformly spaced parallel grid elements 32 which extend perpendicular to the longitudinal direction of the electron emitter 31, the supply leads 33 for the grid elements being insulated from one another on the insulating layer 37. The grid elements 32 can be formed by tungsten wires or carbon whiskers which are capable of withstanding high thermal loads.

In the operating condition each grid element 32 can be connected to a first potential U1 (blocking potential) which is negative relative to the potential of the electron emitter 31 (for example, −4 kV) and to a second potential U2 (transmission potential) which corresponds to the potential of the electron emitter 31.

Figure 3:
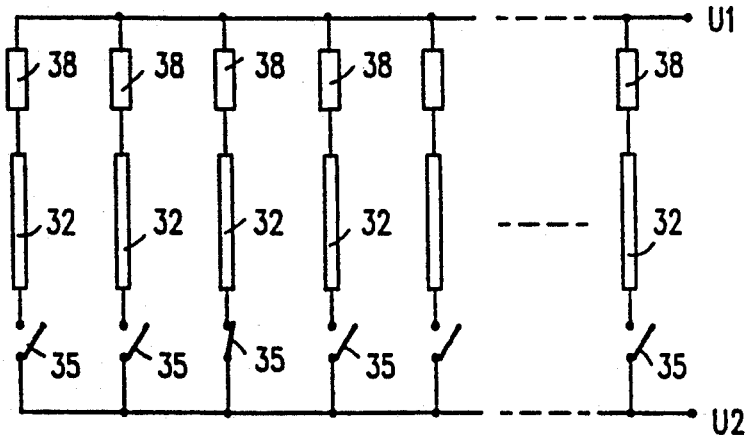
FIG. 3 illustrates the connection of the grid elements of the embodiment of FIG. 2 to the various potentials.

FIG. 3 shows a circuit arrangement enabling periodic displacement of the focal spot. Via a high-ohmic resistor 38, each grid element 32 is connected to a terminal connected to the first potential U1 and, via a respective switch 35, to a terminal connected to the second potential U2. In the initial state, all switches 35 (for example, semiconductor switches) are open, so that all grid elements carry the blocking potential U1 via the resistors 38. When one of the switches 35 or a group of neighboring switches is closed, the relevant grid elements are connected to the cathode potential U2. This area can then be passed by electrons from the emitter 31. When the switches 35 are controlled by a control circuit (not shown) so that the grid elements 32 are periodically and individually successively connected to the cathode potential U2 so that always no more than one grid element is connected to the transmission potential U2, on the anode 2 a focal spot displacement is achieved which progresses, for example from left to right in a step-wise and periodic manner.

However, the grid arrangement can also be used to change the focal spot merely as regards its size; in that case additionally one or more neighbouring switches must be closed.

I claim:

1. An X-ray tube for generating a variable focal spot, comprising:

a cathode whose dimensions are adapted for focal spot dimension variation, an anode, and a grid arrangement between the cathode and the anode of the X-ray tube, said grid arrangement comprising a plurality of coplanar grid elements, said grid elements being electrically insulated from one another and having respective potentials mutually independently controllable.

2. An X-ray tube as claimed in claim 1 wherein for the displacement of the focal spot in a direction, the grid arrangement comprises grid elements adjacently arranged in said displacement direction and adapted to be successively connected to a potential such that the electrons emitted by the cathode pass the grid at the area of the grid element receiving said potential.

3. An X-ray tube as claimed in claim 1 including means for constructing the anode and the cathode as a rotary-anode X-ray tube.

4. An X-ray tube as claimed in claim 2 including means for constructing the anode and the cathode as a rotary-anode X-ray tube.

* * * * *